US009840920B2

(12) United States Patent
Pearson et al.

(10) Patent No.: US 9,840,920 B2
(45) Date of Patent: Dec. 12, 2017

(54) METHODS AND APPARATUS FOR SEALING A GAS TURBINE ENGINE ROTOR ASSEMBLY

(71) Applicant: General Electric Company, Schenectady, NY (US)

(72) Inventors: Shawn Michael Pearson, West Chester, OH (US); Steven Robert Brassfield, Cincinnati, OH (US); Mark Edward Stegemiller, Franklin, OH (US); Jonathan Filipa, Liberty Township, OH (US); Daniel Lee Durstock, Ft. Wright, KY (US)

(73) Assignee: General Electric Company, Schenectady, NY (US)

( * ) Notice: Subject to any disclaimer, the term of this patent is extended or adjusted under 35 U.S.C. 154(b) by 330 days.

(21) Appl. No.: 14/407,867

(22) PCT Filed: Jun. 14, 2013

(86) PCT No.: PCT/US2013/188731

§ 371 (c)(1),
(2) Date: Dec. 12, 2014

(87) PCT Pub. No.: WO2013/188731

PCT Pub. Date: Dec. 19, 2013

(65) Prior Publication Data

US 2015/0167480 A1 Jun. 18, 2015

Related U.S. Application Data

(60) Provisional application No. 61/660,307, filed on Jun. 15, 2012.

(51) Int. Cl.

| | |
|---|---|
| ***F01D 5/30*** | (2006.01) |
| ***F01D 5/22*** | (2006.01) |
| ***F01D 11/00*** | (2006.01) |

(52) U.S. Cl.
CPC ..... *F01D 5/30* (2013.01); *F01D 5/22* (2013.01); *F01D 5/3015* (2013.01); *F01D 11/00* (2013.01);

(Continued)

(58) Field of Classification Search
CPC ... F01D 5/30; F01D 11/00; F01D 5/22; F01D 11/006; F01D 5/3015; F05D 2240/57
See application file for complete search history.

(56) References Cited

U.S. PATENT DOCUMENTS 3,918,842 A * 11/1975 Longley ..... F01D 5/22 416/193 A
5,224,822 A * 7/1993 Lenahan ..... C23C 30/00 415/177

(Continued)

FOREIGN PATENT DOCUMENTS

DE 19810567 A1 9/1998
GB 2127104 A 4/1984

(Continued)

OTHER PUBLICATIONS

Search Report and Written Opinion issued in connection with corresponding patent application PCT/US2013/045791 dated Aug. 13, 2013.

*Primary Examiner* — Gregory Anderson
*Assistant Examiner* — Eldon Brockman
(74) *Attorney, Agent, or Firm* — General Electric Company; William Scott Andes

(57) ABSTRACT

A rotor assembly for use in a gas turbine engine having an axis of rotation includes a plurality of rotor blades. Each rotor blade includes a platform extending between opposing side faces, a shank extending radially inward from the platform, and a slot at least partially defined in each of the opposing side faces. A sealing member is configured to be inserted into each slot of a first rotor blade of the plurality (Continued)

of rotor blades such that at least a portion of each sealing member extends beyond one of the opposing side faces. A second rotor blade of the plurality of rotor blades is coupled adjacent the first rotor blade such that at least a portion of one sealing member is inserted into a corresponding second slot on the second rotor blade.

18 Claims, 9 Drawing Sheets

(52) U.S. Cl.
CPC ..... *F01D 11/006* (2013.01); *F05D 2240/57* (2013.01); *Y10T 29/49321* (2015.01)

(56) References Cited

U.S. PATENT DOCUMENTS 6,086,329 A * 7/2000 Tomita ..... F01D 11/006 277/634
7,140,835 B2 * 11/2006 Lee ..... F01D 5/187 415/115
7,762,780 B2 * 7/2010 Decardenas ..... F01D 5/147 416/193 A
8,011,892 B2 9/2011 Ramlogan et al.
8,540,486 B2 * 9/2013 Johnson ..... F01D 5/181 416/193 A
8,790,086 B2 * 7/2014 Honkomp ..... F01D 11/006 416/190
8,820,754 B2 * 9/2014 Stewart ..... F01D 5/22 277/641
8,905,715 B2 * 12/2014 Boyer ..... F01D 5/22 416/193 A
2005/0186074 A1 * 8/2005 Tomita ..... F01D 5/22 416/97 R
2008/0181779 A1 * 7/2008 Decardenas ..... F01D 5/147 416/219 R
2008/0199307 A1 8/2008 Keller
2009/0004013 A1 * 1/2009 Ramlogan ..... F01D 5/22 416/190
2010/0129226 A1 5/2010 Strohl et al.
2010/0143139 A1 * 6/2010 Pandey ..... F01D 5/143 416/179
2011/0081245 A1 * 4/2011 Walunj ..... F01D 5/3015 416/179
2011/0229344 A1 * 9/2011 Johnson ..... F01D 5/181 416/97 R
2012/0049467 A1 * 3/2012 Stewart ..... F01D 5/22 277/641
2012/0114480 A1 5/2012 Amaral et al.
2012/0121423 A1 * 5/2012 Honkomp ..... F01D 11/006 416/190
2012/0237352 A1 * 9/2012 Boyer ..... F01D 5/22 416/221
2012/0275920 A1 * 11/2012 Delvaux ..... F01D 5/3015 416/204 R

FOREIGN PATENT DOCUMENTS

WO 0057031 A1 9/2000
WO 2010051453 A2 5/2010
WO 2011156437 A1 12/2011

* cited by examiner

METHODS AND APPARATUS FOR SEALING A GAS TURBINE ENGINE ROTOR ASSEMBLY

CROSS-REFERENCE TO RELATED APPLICATIONS

This application is a non-provisional application and claims priority to U.S. Provisional Patent Application Ser. No. 61/660,307 filed Jun. 15, 2012 for "TURBINE BLADE PLATFORM SEAL", which is hereby incorporated by reference in its entirety.

BACKGROUND

The application described herein relates generally to gas turbine engines components, and more specifically to an apparatus for sealing the gap between adjacent turbine blade platforms.

A typical gas turbine engine has an annular axially extending flow path for conducting air sequentially through a compressor section, a combustion section, and a turbine section. The compressor section includes a plurality of rotating blades which add energy to the air. The air exits the compressor section and enters the combustion section. Fuel is mixed with the compressed air, and the resulting combustion gases mixture is ignited to add more energy to the system. The resulting products of the combustion then expand through the turbine section. The turbine section includes another plurality of rotating blades, which extract energy from the expanding air. A rotor shaft interconnecting the compressor section and turbine section transfers a portion of this extracted energy back to the compressor section. The remainder of the energy extracted may be used to power a load, for example, a fan, a generator, or a pump.

At least some known rotor assemblies include at least one row of circumferentially-spaced rotor blades. Each rotor blade includes an airfoil that includes a pressure side and a suction side connected together at leading and trailing edges. Each airfoil extends radially outward from a rotor blade platform to a tip, and also includes a dovetail that extends radially inward from a shank extending between the platform and the dovetail. The dovetail is coupled to the rotor blade within the rotor assembly to a rotor disk.

The sides of platform sections of adjacent blades in a row of blades abut each other to form a portion of the boundary defining the flow path for the air and combustion gases. Although it would be desirable to have adjacent platforms abut in a perfect sealing relationship, the necessity to accommodate thermal growth and machining tolerances results in a small gap being maintained between adjacent platforms.

In order to couple the dovetail to the rotor disk, the dovetail must be machined to be slightly smaller than the slot into which it is inserted. This causes small buffer cavities in front and behind the dovetail. During operation of the turbine, cooling air may leak from the front buffer cavity, across the top of the disk, to the buffer cavity behind the dovetail, through the gap between aft skirts of adjacent rotor blades and into the flow path of the combustion gases. Leakage of the air into the flow path of the hot combustion gases causes a loss in the engine cycle and therefore decreases the engine efficiency. It is desirable to reduce this leakage to decrease specific fuel consumption, therefore increasing engine efficiency.

Accordingly, there exists a need to provide an improved device for sealing the gap between turbine rotor blade platforms of adjacent rotating blades in a gas turbine engine.

BRIEF DESCRIPTION

In one aspect, a rotor assembly for use in a gas turbine engine having an axis of rotation is provided. The rotor assembly includes a plurality of rotor blades. Each rotor blade includes a platform extending between opposing side faces, a shank extending radially inward from the platform, and a slot at least partially defined in each of the opposing side faces. A sealing member is configured to be inserted into each slot of a first rotor blade of the plurality of rotor blades such that at least a portion of each sealing member extends beyond one of the opposing side faces. A second rotor blade of the plurality of rotor blades is coupled adjacent the first rotor blade such that at least a portion of one sealing member is inserted into a corresponding second slot on the second rotor blade.

In another aspect, a gas turbine engine having an axis of rotation is provided. The gas turbine engine comprises a rotating shaft and a rotor assembly coupled to the shaft. The rotor assembly includes a plurality of rotor blades, and each rotor blade includes a platform extending between opposing side faces, a shank extending radially inward from the platform, and a slot at least partially defined in each of the opposing side faces. A sealing member is configured to be inserted into each slot of a first rotor blade of the plurality of rotor blades such that at least a portion of each sealing member extends beyond one of the opposing side faces. A second rotor blade of the plurality of rotor blades is coupled adjacent the first rotor blade such that at least a portion of one sealing member is inserted into a corresponding second slot on the second rotor blade.

In yet another aspect, a method of assembling a rotor assembly for use with gas turbine engine having an axis of rotation is provided. The method comprises providing a plurality of rotor blades. Each rotor blade includes a platform extending between opposing side faces, a shank extending radially inward from the platform, a dovetail extending radially inward from the shank, and a slot at least partially defined in each of the opposing side faces. A sealing member is inserted into each slot of a first rotor blade of the plurality of rotor blades such that at least a portion of each sealing member extends beyond one of the opposing side faces. A second rotor blade of the plurality of rotor blades is coupled adjacent the first rotor blade such that at least a portion of one sealing member is inserted into a corresponding second slot on the second rotor blade.

BRIEF DESCRIPTION

FIGS. 1-8 show exemplary embodiments of the turbine blade platform seal as described herein.

FIG. 1 is a schematic view of the components of a known gas turbine engine.

FIG. 3 is a radial top view of a seal pin sealing a gap between two rotor blades.

FIG. 5 is a tapered seal pin with a radially outer radius greater than a radially inner radius.

FIG. 6 is a perspective view of a rotor blade with a spline seal coupled thereto.

FIG. 7 is an axial forward looking cross-sectional view of a spline seal housed within a slot formed by adjacent rotor blades to seal the gap between rotor blades.

FIG. 8 is a perspective view of a portion of a rotor blade having an open ended slot to receive a spline seal.

DETAILED DESCRIPTION

As combustion air flows through the gas turbine engine, the pressure of the air is relatively higher upstream of the rotor blades than it is downstream of the rotor blades. Because of the pressure differential, some of the air flowing through the turbine may leak through a gap that exists between adjacent rotor blades and cause the engine to perform less efficiently than if the gap were sealed to prevent leakage. Similar seals exist in other applications, but embodiments of the present invention apply the use of a seal in a rotational environment.

Figure 1:
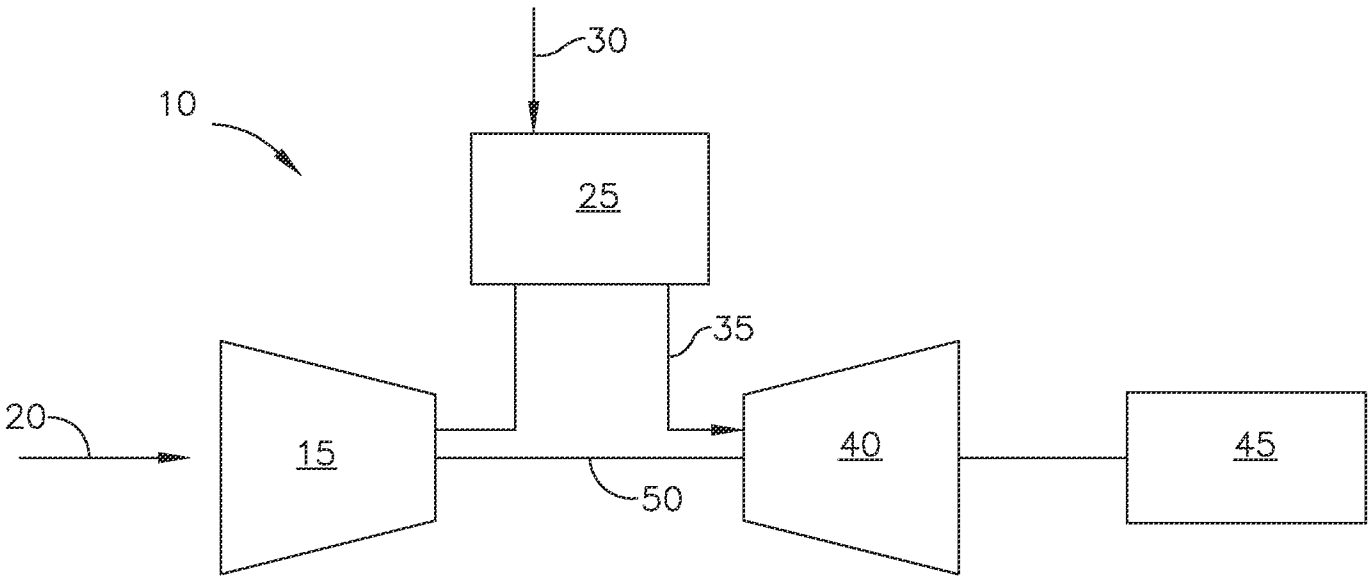

Referring now to the drawings, in which like numerals refer to like elements throughout the several views, FIG. 1 shows a schematic view of the components of a known gas turbine engine 10. Gas turbine engine 10 may include a compressor 15 coupled in flow communication with a combustor 25 further coupled in flow communication with a turbine 40. Compressor 15 and turbine 40 are each coupled to a rotor shaft 50. Turbine 40 is also coupled to an external load 45 via rotor shaft 50 or an additional rotor shaft. Shaft 50 provides an axis of rotation for engine 10.

During operation, compressor 15 compresses an incoming flow of air 20. Compressor 15 delivers the compressed flow of air 20 to a combustor 25. Combustor 25 mixes the compressed flow of air 20 with a flow of fuel 30 and ignites the mixture to create a flow of combustion gases 35. Although only a single combustor 25 is shown, gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives a rotor shaft 50 to power compressor 15 and any additional external load 45 such as an electrical generator and the like.

Gas turbine engine 10 may use natural gas, various types of syngas, and other types of fuels. Gas turbine engine 10 may be one of any number of different gas turbines offered by General Electric Company of Schenectady, N.Y. or otherwise. Gas turbine engine 10 may have other configuration and may use other types of components. Other types of gas turbine engines also may be used herein. Multiple gas turbine engines 10, other types of turbines, and other types of power generation equipment may be used herein together.

Figure 2B:
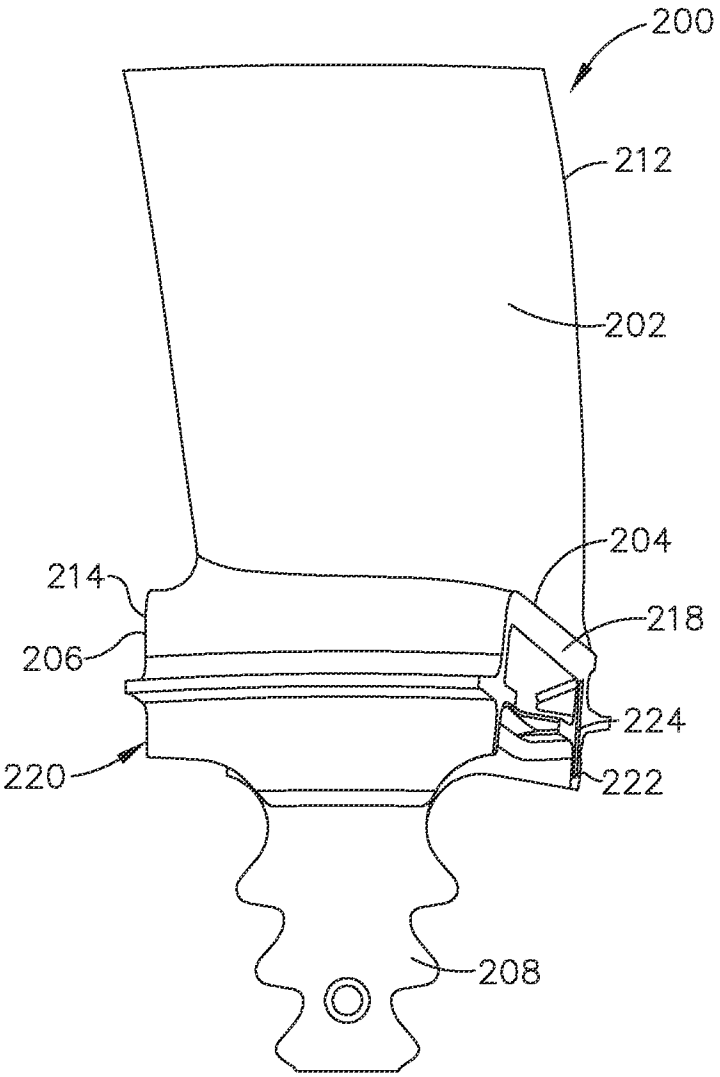
FIG. 2B is an axial front view of a rotor blade that may be used with the gas turbine engine shown in FIG. 1.
Figure 2A:
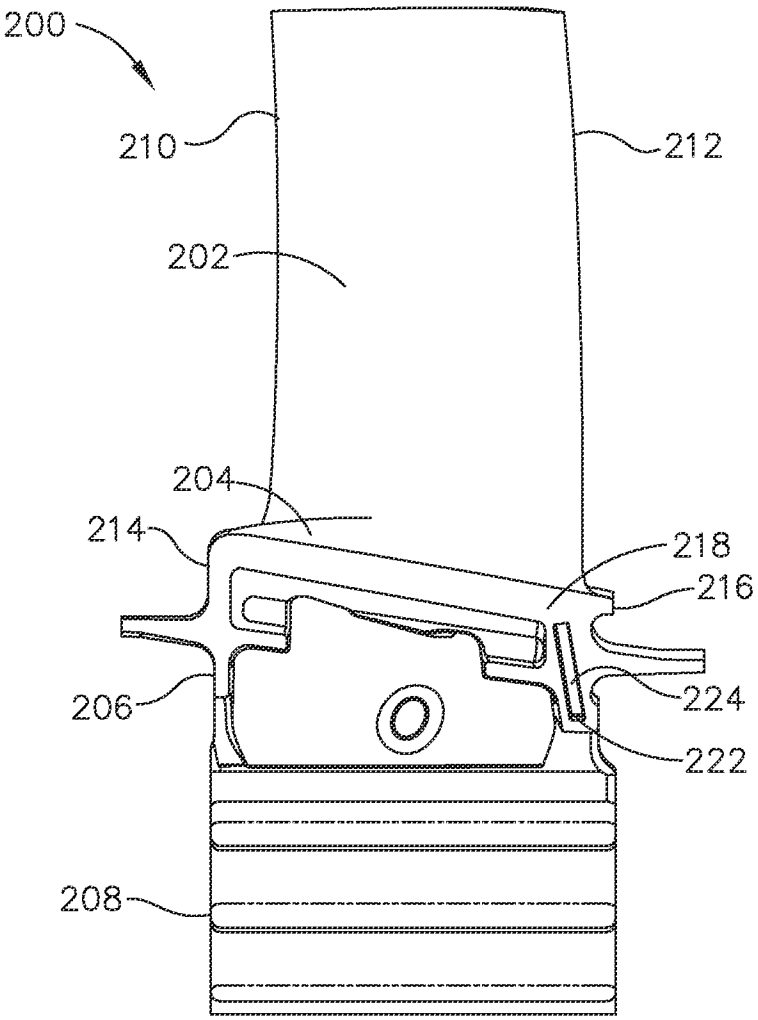
FIG. 2A is a side view of a rotor blade that may be used with the gas turbine engine shown in FIG. 1.

FIG. 2A is a side view of a rotor blade 200 that may be used with gas turbine engine 10 (shown in FIG. 1). When blades 200 are coupled within a rotor assembly, such as turbine 40 (shown in FIG. 1), a predetermined platform gap (not shown in FIG. 2) is defined between circumferentially adjacent rotor blades 200. In the exemplary embodiment, blade 200 has been modified to include features that provide a seal between blades 200 to be described in further detail below.

When coupled within rotor assembly 40, each rotor blade 200 is coupled to a rotor disk (not shown) that is rotatably coupled to a rotor shaft, such as shaft 50 (shown in FIG. 1). In an alternative embodiment, blades 200 are mounted within a rotor spool (not shown). In the exemplary embodiment, circumferentially adjacent blades 200 are identical and each extends radially outward from the rotor disk and includes an airfoil 202, a platform 204, a shank 206, and a dovetail 208. In the exemplary embodiment, airfoil 202, platform 204, shank 206, and dovetail 208 are collectively known as a blade.

FIGS. 2A and 2B illustrate a leading edge 210 and a trailing edge 212 of airfoil 202. Leading edge 210 is on the forward side of airfoil 202, and trailing edge 212 is on the aft side. As used herein, "forward" and "upstream" are used to refer to the inlet end of a turbine in a gas turbine engine, and "aft" and "downstream" are used to refer the to the opposite, outlet, end of a turbine in a gas turbine engine.

Platform 204 extends between airfoil 202 and shank 206 such that each airfoil 202 extends radially outward from each respective platform 204. Shank 206 extends radially inwardly from platform 204 to dovetail 208, and dovetail 208 extends radially inwardly from shank 206 to facilitate securing rotor blades 200 to the rotor disk. Platform 204 also includes a forward skirt 214 and an aft skirt 216 that are connected together with first slash face side 218 and an opposite second slash face side 220. First slash face side 218 of shank 206 may include a cavity 222 for receiving a moveable element, for example, a moveable seal. It is contemplated that the moveable seal may be a seal pin 224.

Figure 3:
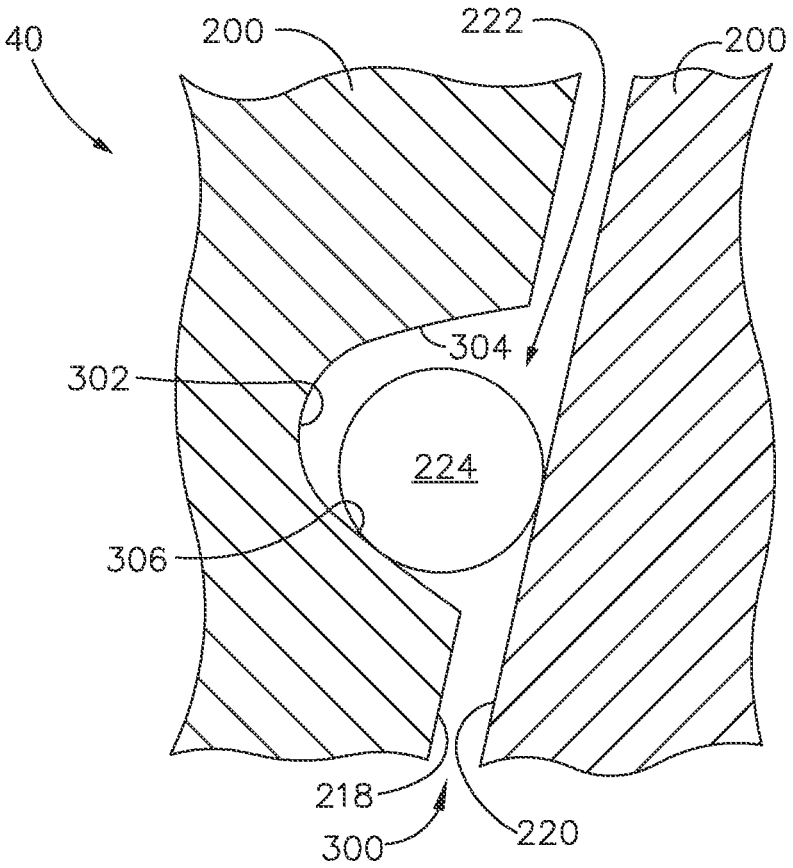
Figure 4A:
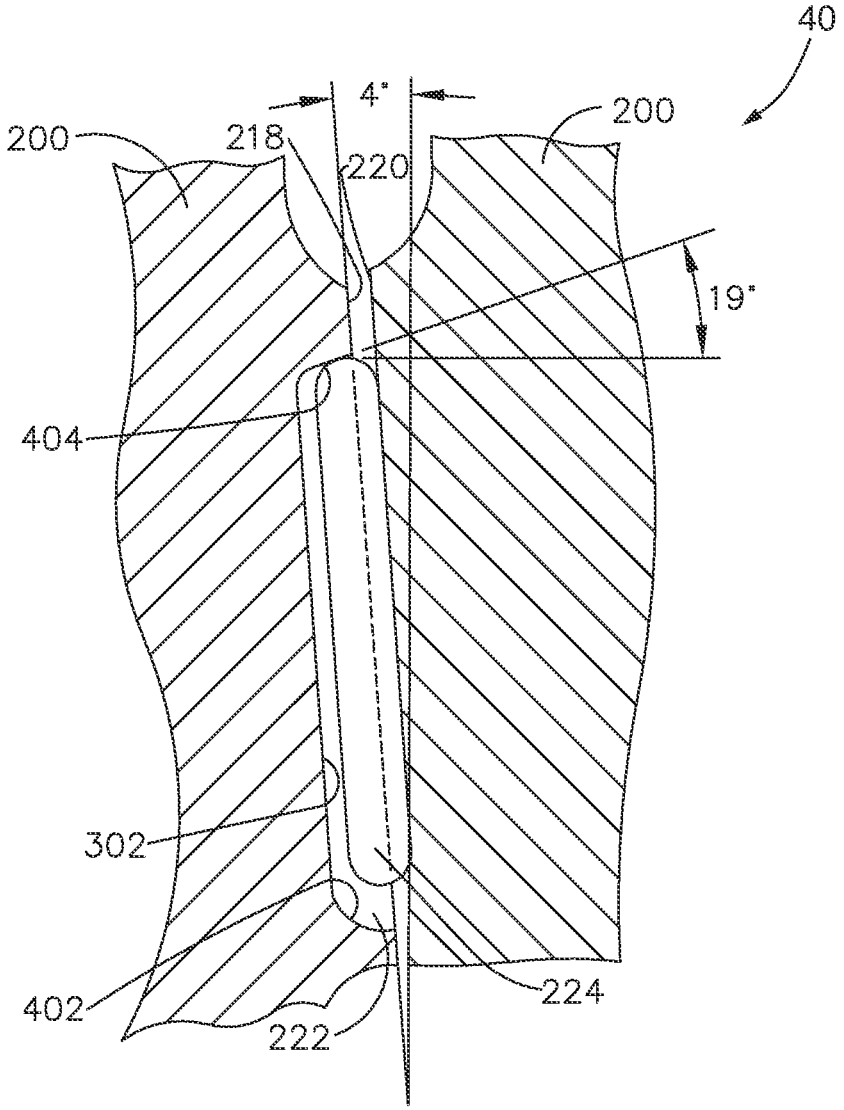
FIG. 4A is an axial forward looking view of a seal pin sealing the gap between two rotor blades.
Figure 4B:
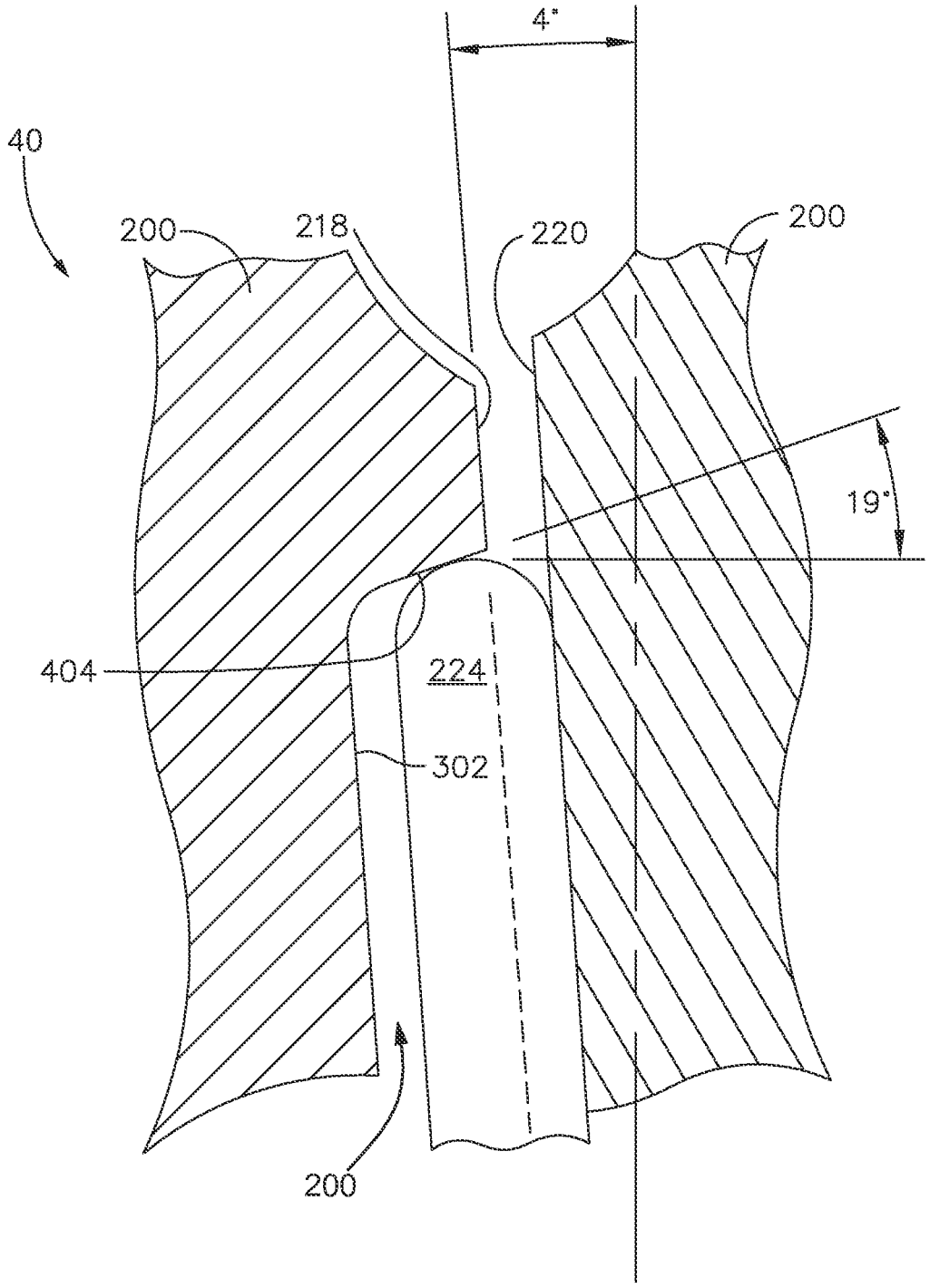
FIG. 4B is a close up portion of FIG. 4A illustrating a seal pin sealing the gap between two rotor blades.

FIGS. 3-4B show seal pin 224 within cavity 222 and operating to provide a seal configured to prevent cooling air from leaking between aft skirts 216 of adjacent rotor blades 200. When rotor blades 200 are coupled within rotor assembly 40, a platform gap 300 is defined between adjacent rotor blade platforms 204. Centrifugal forces of rotating rotor assembly 40 cause seal pin 224 to seal platform gap 300 as described in further detail below. Cavity 222 is defined by a back surface 302, a forward side surface 306, an aft side surface 304, a radially inner surface 402, and a radially outer surface 404. Back surface 302 and radially inner surface 402 are rounded in order to limit binding the movement of the ends of seal pin 224 within cavity 222. Side surfaces 304 and 306 are angled such that they are wider at the opening of cavity 222 than where they connect to back surface 302. Seal pin 224 contacts top surface 302 due to centrifugal force acting upon seal pin 224. Top surface 404 is angled such that it directs seal pin 224 to fall toward the second slash face side 220 of adjacent rotor blade 200.

Seal pin 224 is substantially circular in cross-section and extends radially within cavity 222. In the exemplary embodiment, seal pin 224 has a diameter of approximately 0.04 inches. However, because the dimensions of rotor blade 200 may vary, depending on the engine size in which it is used, seal pin 224 may have any diameter sufficient to facilitate operation of rotor assembly 40 as described herein. Seal pin 224 is rounded at each of the two ends (best shown in FIG. 4A) to reduce binding with top surface 404 and bottom surface 402 during movement from a first position to a second position (shown in FIG. 4A).

Cavity 222 extends far enough into shank 206 to allow seal pin 224 to be housed substantially entirely within cavity 222. In other words, seal pin 224 may include a maximum outside diameter that is less than the distance between the deepest portion of cavity 222 and a plane extending along first slash face side 218 of rotor blade 100. Thus, seal pin 224 may be sufficiently recessed within cavity 222 to provide clearance for sliding an adjacent rotor blade into rotor disk.

Although only a single seal pin 224 is illustrated for rotor blade 200, seal pin 224 may be positioned between each of opposing rotor blades 200 of a turbine stage. For example, a first turbine stage including seventy-two rotor blades 200 may include seventy-two seal pins 224.

In operation, seal pin 224 initially sits at the bottom of cavity 222 such that the radially inner end of seal pin 224 is adjacent to bottom surface 402. As rotor assembly 40 begins to rotate, centrifugal force slides seal pin 224 in a radially outward direction within cavity 222. As seal pin 224 comes into contact with top surface 404, the angle of top surface 404 forces seal pin 224 to fall against the flat second slash face surface 220 of the adjacent rotor blade 200, forming a seal. To facilitate this seal top surface 404 has an angle of approximately 19 degrees. However, because the dimensions of rotor blade 200 may vary, depending on the engine size in which it is used, top surface 404 may have any angle sufficient to force seal pin 224 to fall against the flat second slash face surface 220 of the adjacent rotor blade 200. In order to accommodate the angles defining the walls of cavity 222, platform 204, shank 206, and slash face sides 220 and 218 are manufactured with a tilt of approximately 4 degrees from radially vertical. However, because the dimensions of rotor blade 200 may vary, depending on the engine size in which it is used, slash face sides 220 and 218 may have any angle sufficient to facilitate seal pin 224 in forming a seal. This slash face angle causes seal pin 224 to fall against the flat second slash face side 220 of the adjacent rotor blade 200, such that the entire length of seal pin 224 is in contact with second slash face 220 to provide a continuous seal. Without the slash face angle, the moment caused by the rotating disc would cause only the radially outer tip of seal pin 224 to contact second slash face surface 220 of the adjacent rotor blade 200 while the radially inner end of pin 224 would remain within cavity 222, and a seal would not be formed.

Figure 5:
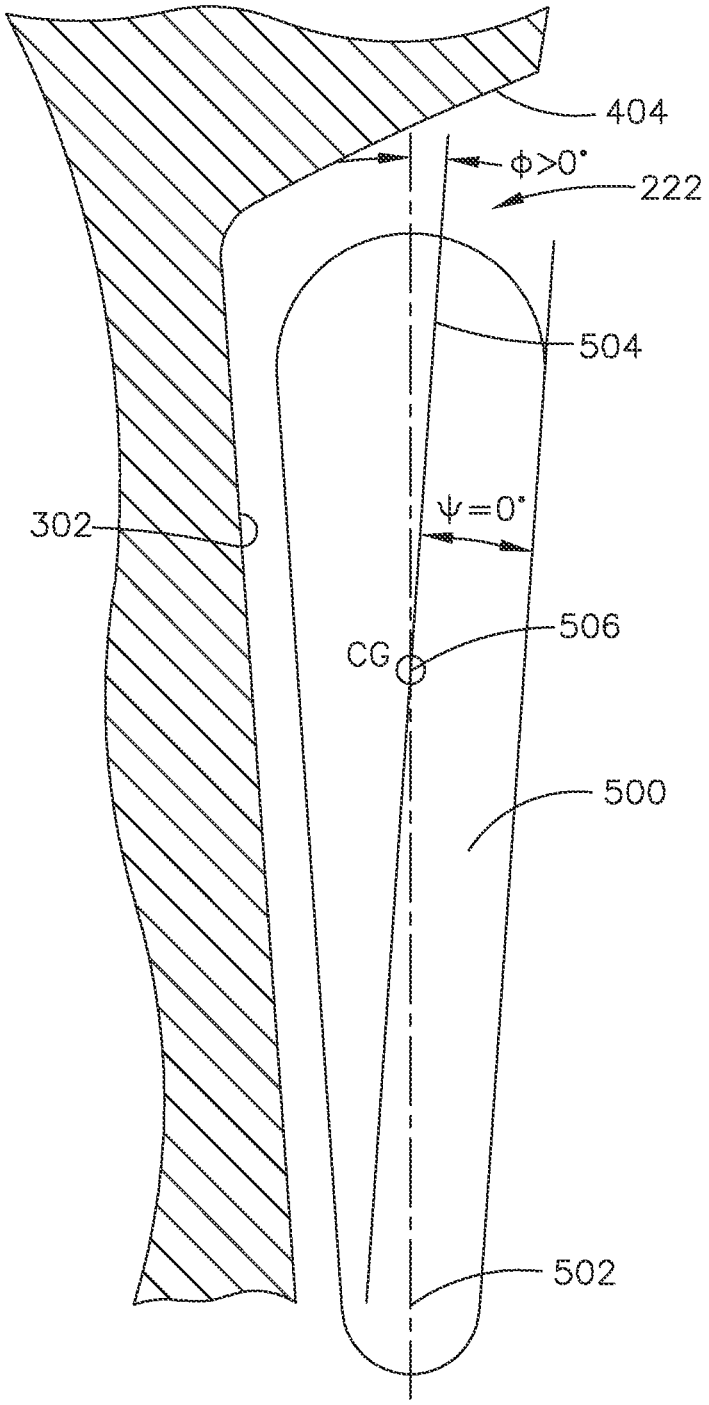

In another embodiment, FIG. 5 shows a tapered seal pin 500 with a radially outer radius greater than a radially inner radius that functions in a similar manner as seal pin 224. Tapered seal pin 500 may be used within the same cavity as shown in FIGS. 3-4B.

Tapered seal pin 500 is substantially circular in cross-section and extends radially within cavity 222. In the exemplary embodiment, tapered seal pin 500 has a radially outer diameter of approximately 0.08 inches and a radially inner diameter of approximately 0.04 inches. However, because the dimensions of rotor blade 200 may vary, depending on the engine size in which it is used, tapered seal pin 500 may have any diameter sufficient to permit passage of an adjacent rotor blade 200 during assembly. Tapered seal pin 500 is rounded at each of the two ends, for example, to reduce binding with top surface 404 and bottom surface 402 during movement from a first position to a second position (shown in FIG. 4A).

Centerline axis reference line 502 travels through a center of gravity 506 of tapered seal pin 500 to the centerline of engine 10 such that reference line 502 enters tapered seal pin 500 at the center of the radially outer tip and exits at the center of the radially inner tip. A second reference line 504 also travels through center of gravity 506 of tapered seal pin 500, but reference line 504 is perpendicular to centerline of engine 10. Phi is the angle measured between reference lines 502 and 504 at center of gravity 506 of tapered seal pin 500. An angle where phi is greater than zero is required to cause tapered seal pin 500 to slide up cavity 222 and fall against the adjacent rotor blade 200, described in further detail below. If phi is less than zero, then the moment created by the rotating disc causes the radially inner portion of tapered seal pin 500 to rotate away from the adjacent blade, and a seal is not formed.

Although only a single tapered seal pin 500 is illustrated for rotor blade 200, it is contemplated that a tapered seal pin 500 may be positioned between each of opposing rotor blades 200 of a turbine stage. For example, a first turbine stage including seventy-two rotor blades 200 may include seventy-two tapered seal pins 500.

In operation, tapered seal pin 500 initially sits at the bottom of cavity 222 such that the radially inner end of seal pin 224 is adjacent to bottom surface 402. As rotor assembly 40 begins to rotate, centrifugal force slides tapered seal pin 500 in a radially outward direction within cavity 222. As tapered seal pin 500 comes into contact with top surface 404, the angle of top surface 404 forces tapered seal pin 500 to fall against the flat second slash face surface 220 of the adjacent rotor blade 200, forming a seal. To facilitate tapered seal pin 500 forming a seal, top surface 404 has an angle of approximately 19 degrees. However, because the dimensions of rotor blade 200 may vary, depending on the engine size in which it is used, top surface 404 may have any angle sufficient to force tapered seal pin 500 to fall against the flat second slash face surface 220 of the adjacent rotor blade 200. In the present embodiment, the taper of tapered seal pin 500 allows a seal to be formed against second slash face surface 220 of the adjacent rotor blade 200 without requiring platform 204, shank 206, and slash face sides 220 and 218 to be manufactured with a slash face angle.

Tapered seal pin 500 allows a seal to be created in platform gap 300 without modifying the angle of platform 204, shank 206, and slash face sides 220 and 218. A seal is still created in platform gap 300 with platform 204, shank 206, and slash face sides 220 and 218 in a substantially vertical formation.

Figure 6:
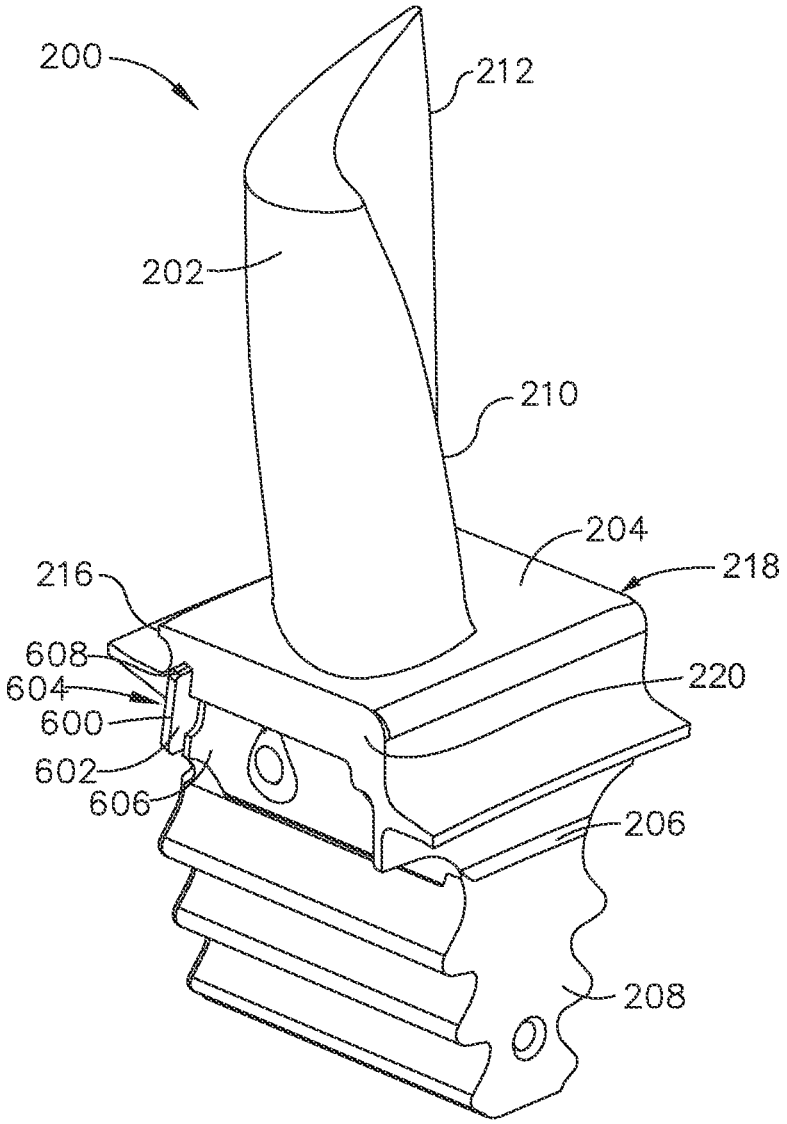

FIG. 6 shows a perspective view of yet another embodiment of the present invention where a spline seal 600 bridges gap 300 between adjacent circumferential rotor blades 200 of rotor assembly 40. In the exemplary embodiment, blade 200 has been modified to include features that provide a seal between blades 200 to be described in further detail below. Spline seals are known to be used in turbines for sealing the gaps between the shrouds of adjacent stationary vanes. However, stationary vanes are not subject to centrifugal forces during operation of the turbine as such are rotor blades. Embodiments of the present invention apply the use of spline seal 600 in a rotational environment, such as rotor assembly 40. In the exemplary embodiment, spline seal 600 may be a thin rectangular member having a height of approximately 0.3715 inches, a width of approximately 0.15 inches, and a thickness of approximately 0.01 inches in the axial direction. However, because the dimensions of rotor blade 200 may vary, depending on the engine size in which it is used, spline seal 600 may have any dimensions sufficient to prevent leakage of air through gap 300 between adjacent rotor blades 200. Spline seal 600 may be formed of a high temperature alloy material having a forward surface 602 and an aft surface 604.

In the exemplary embodiment, circumferentially adjacent blades 200 are identical and each extends radially outward from the rotor disk and includes an airfoil 202, a platform 204, a shank 206, and a dovetail 208. In the exemplary embodiment, airfoil 202, platform 204, shank 206, and dovetail 208 are collectively known as a blade. Platform 204 extends between airfoil 202 and shank 206 such that each airfoil 202 extends radially outward from each respective platform 204. Shank 206 extends radially inwardly from platform 204 to dovetail 208, and dovetail 208 extends radially inwardly from shank 206 to facilitate securing rotor blades 200 to the rotor disk.

An aft portion of platform 204, such as aft skirt 216, includes a radially outward portion of a slot 608 that is machined into platform 204 to accept the radially outward portion of spline seal 600 near aft skirt 216. A seal support structure 606 extends outward from shank 206 and includes a radially inward portion of slot 608 configured to accept the radially inward portion of spline seal 600. Seal support structure 606 is positioned radially inward of platform 204 such that spline seal 600 may be inserted into slot 608 defined by seal support structure 606 and platform 204.

Figure 7:
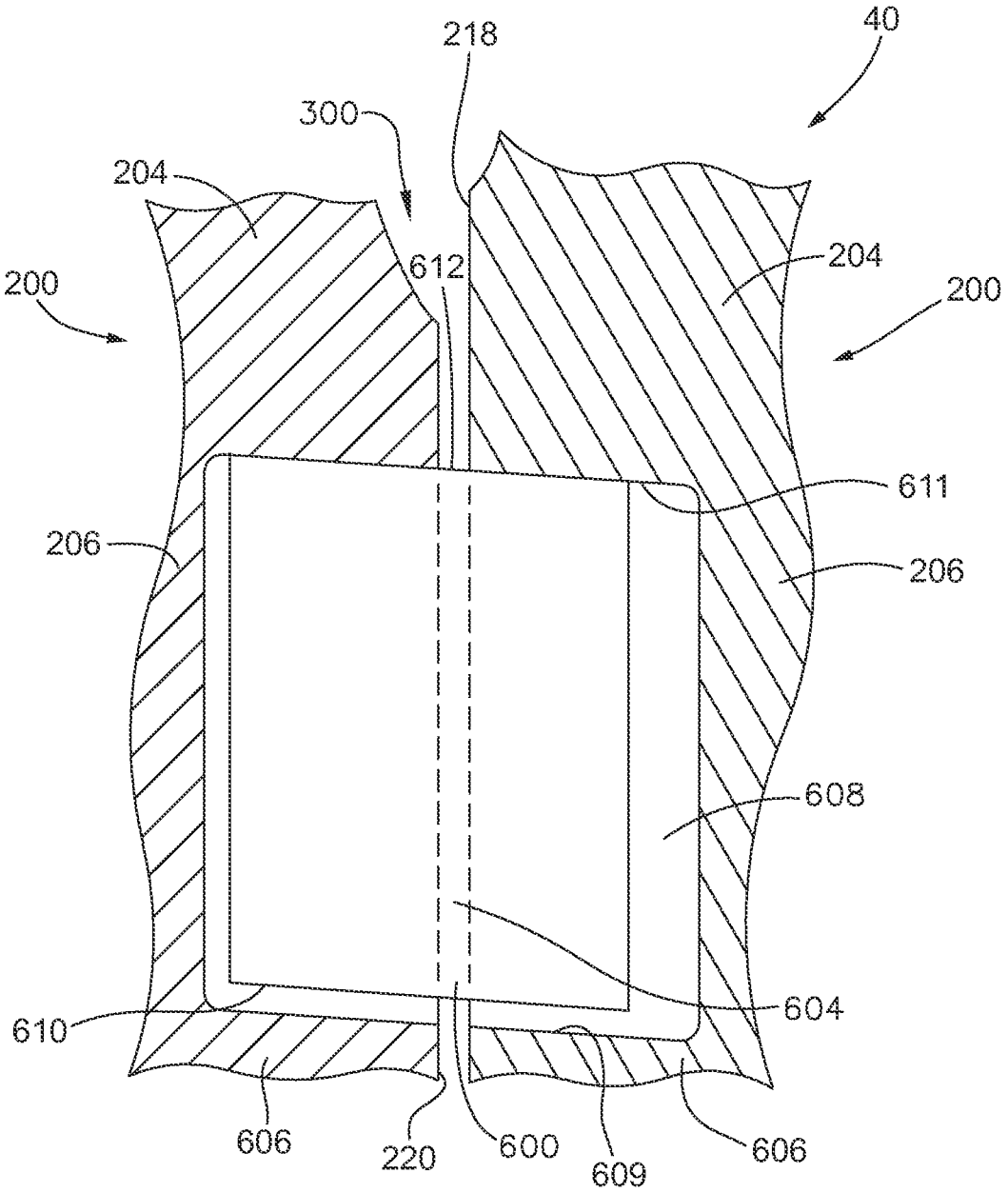

FIG. 7 is a forward looking axial view of spline seal 600 housed within slot 608 formed by adjacent rotor blades 200 to seal gap 300 between rotor blades 200. Rotor blade 200 includes identical structure on opposing sides such that opposing sides both include seal support structure 606 and platform 204, which define slot 608. Adjacent rotor blades 200 are identical such that adjacent rotor blades 200 each include opposing sides both having seal support structure 606 and platform 204, which define slot 608. Spline seal 600 is inserted into slot 608 in rotor blade 200 such that a portion of spline seal extends beyond the vertical plane defined by the side of platform 204. Adjacent rotor blade 200 is then coupled to rotor blade 200 having spline seal 600 such that gap 300 is formed between adjacent rotor blades 200. The portion of spline seal 600 extending beyond rotor blade is inserted into an identical slot 608 on adjacent rotor blade 200, such that spline seal 600 bridges gap 300 and is fully contained within slot 608, thus interlocking adjacent rotor blades 200.

In operation, spline seal 600 initially sits at a radially inner portion of slot 608 such that a radially inner end 610 of spline seal 600 is in contact with a radially inner surface 609 of slot 608 on support structure 606 of adjacent rotor blades 200. Slot 608 is angled such that, as rotor assembly 40 begins to rotate, centrifugal force causes spline seal 600 to move in a radially outward direction within slot 608. A radially outer end 612 of spline seal 600 contacts a radially outer surface 611 of slot 608, which acts to restrict further movement of spline seal 600 and keep spline seal 600 positioned within slot 608 to prevent the leakage of air between adjacent rotor blades 200. Sealing is achieved when air pressure from the forward side of rotor blade 200 presses spline seal 600 into contact with the aft surfaces of slot 608. This final position of spline seal 600 positions spline seal 600 to prevent leakage and also provides support to spline seal 600 to prevent buckling from the sustained high loads acting on forward seal surface 602 during operation.

Figure 8:
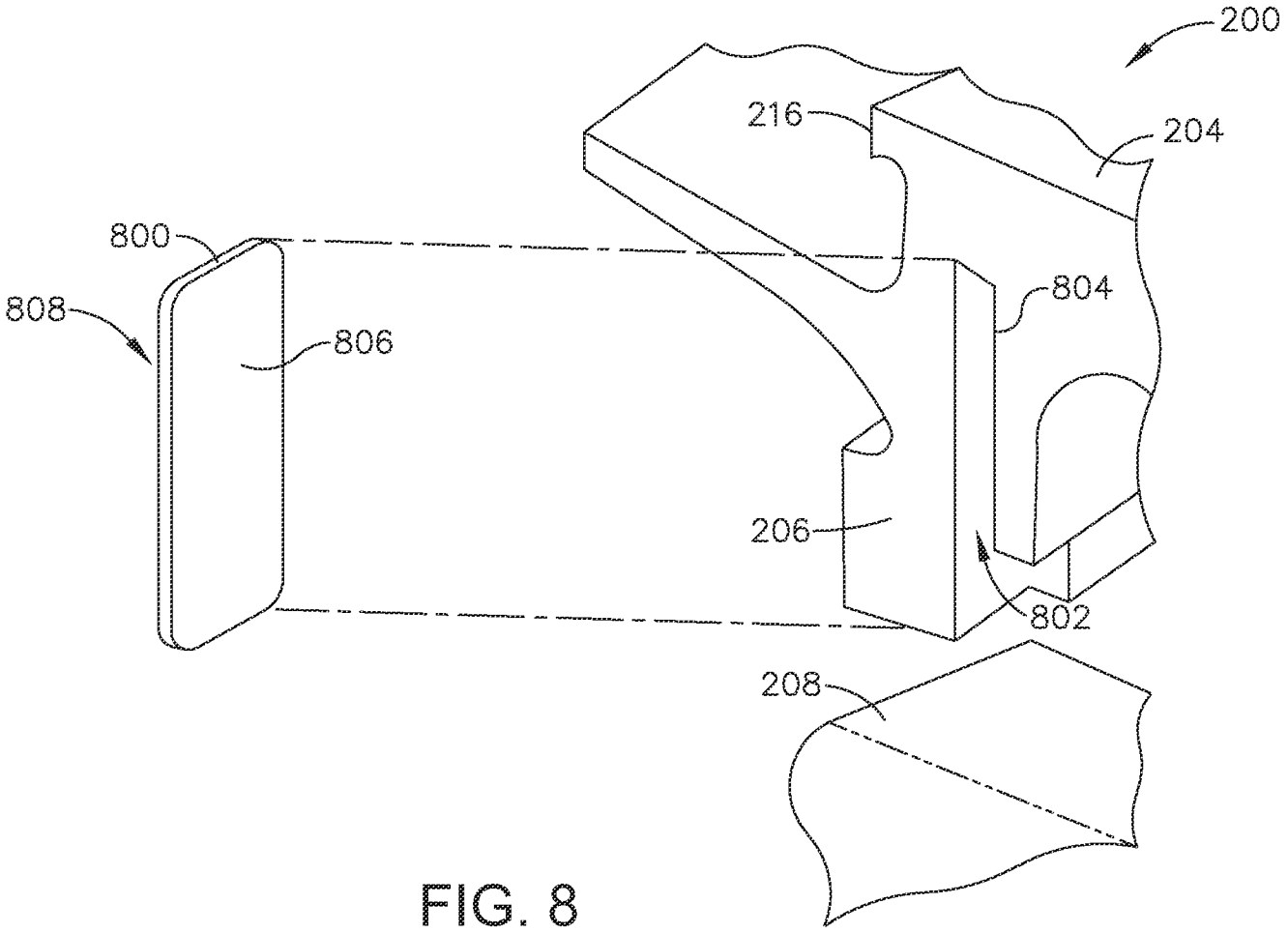

FIG. 8 is a perspective view of a portion of rotor blade 200 having an open ended slot 802 to receive a spline seal 800. Spline seals are known to be used in turbines for sealing the gaps between the shrouds of adjacent stationary vanes. However, stationary vanes are not subject to centrifugal forces during operation of the turbine as such are rotor blades. Embodiments of the present invention apply the use of a spline seal 800 in a rotational environment. Spline seal 800 may be a thin rectangular member having a height of approximately 0.3715 inches, a width of approximately 0.15 inches, and a thickness greater at the radially outer end than at the radially inner end. However, because the dimensions of rotor blade 200 may vary, spline seal 800 may have any dimensions sufficient to prevent leakage of air through gap 300 between adjacent rotor blades 200. Spline seal 800 may be formed of a high temperature alloy material having a forward surface 806 and an aft surface 808.

In the exemplary embodiment, circumferentially adjacent blades 200 are identical and each extends radially outward from the rotor disk and includes an airfoil 202, a platform 204, a shank 206, and a dovetail 208. In the exemplary embodiment, airfoil 202, platform 204, shank 206, and dovetail 208 are collectively known as a bucket. Platform 204 extends between airfoil 202 and shank 206 such that each airfoil 202 extends radially outward from each respective platform 204. Shank 206 extends radially inwardly from platform 204 to dovetail 208, and dovetail 208 extends radially inwardly from shank 206 to facilitate securing rotor blades 200 to the rotor disk.

Slot 802, having a retention feature 804 at the radially outer portion, is machined into an aft portion of platform 204 to accept the radially outward portion of spline seal 800. The greater thickness of the radially outer portion of spline seal 800 fits into retention feature 804 of slot 802 such that spline seal 800 is locked in place. Slot 802 is open-ended at its radially inner portion such that retention feature 804 is the sole method of securing spline seal 800 in place. Spline seal 800 is supported by aft seal surface 808 being in contact with the aft surface of slot 802, such that during operation, combustion gases press against forward seal surface 806 of spline seal 800 to secure aft surface 808 against the aft surface of slot 802. This final position of spline seal 800 places spline seal 800 in a location to prevent leakage and also provides support to spline seal 800 to prevent buckling from the sustained high loads acting on forward seal surface 806 during operation.

The seal pin 224, tapered seal pin 500, and spline seals 600 and 800 each provide an effective seal across gap 300 between adjacent rotor blades 200 thereby preventing the leakage of air under blade platforms 204 and increasing the efficiency of the engine.

Exemplary embodiments of turbine blade platform seals are described above in detail. The seals are not limited to the specific embodiments described herein, but rather, components of systems may be utilized independently and separately from other components described herein. For example, the seals may also be used in combination with other turbine systems, and are not limited to practice with only the turbine engine systems as described herein. Rather, the exemplary embodiment can be implemented and utilized in connection with many other turbine engine applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A rotor assembly for a gas turbine engine, comprising an axis of rotation, said rotor assembly comprising:

a plurality of rotor blades, wherein each rotor blade comprises a platform extending between opposing side faces, a shank extending radially inward from said platform, and a slot at least partially defined in each of said opposing side faces;

a spline seal configured to be inserted into each slot of a first rotor blade of said plurality of rotor blades such that at least a portion of each spline seal extends beyond one of said opposing side faces, wherein a second rotor blade of said plurality of rotor blades is coupled adjacent said first rotor blade such that at least a portion of one spline seal is inserted into a corresponding second slot on said second rotor blade;

each of said plurality of rotor blades comprising a forward skirt attached to an axially forward portion of said rotor bade platform;

each of said plurality of rotor blades comprising an aft skirt attached to an axially aft portion of said rotor bade platform; and one or more seal pins configured to prevent cooling air from leaking between aft skirts.

2. A rotor assembly according to claim 1, wherein said platform comprises a radially outward portion of each slot.

3. A rotor assembly according to claim 1, wherein said shank comprises opposing seal support members.

4. A rotor assembly according to claim 3, wherein each of said opposing seal support members comprises a radially inward portion of each slot.

5. A rotor assembly according to claim 1, wherein each slot is oriented to facilitate movement of said spline seal from a first position to a second position within each slot.

6. A rotor assembly according to claim 1, wherein each spline seal bridges a gap defined between said first rotor blade adjacent to said second rotor blade.

7. A rotor assembly according to claim 1, wherein said spline seal comprises a metallic alloy.

8. A rotor assembly according to claim 1, wherein said spline seal comprises a height of about 0.37 inches, a width of 0.15 inches, and a thickness of 0.01 inches.

9. A gas turbine engine, comprising an axis of rotation, said gas turbine engine comprising:

a rotating shaft; and a rotor assembly coupled to said shaft, wherein said rotor assembly comprises:

a plurality of rotor blades, wherein each rotor blade comprises a platform extending between opposing side faces, a shank extending radially inward from said platform, and a slot at least partially defined in each of said opposing side faces; each of said plurality of rotor blades comprising a forward skirt attached to an axially forward portion of said rotor bade platform and an aft skirt attached to an axially aft portion of said rotor bade platform;

a spline seal configured to be inserted into each slot of a first rotor blade of said plurality of rotor blades such that at least a portion of each spline seal extends beyond one of said opposing side faces, wherein a second rotor blade of said plurality of rotor blades is coupled adjacent said first rotor blade such that at least a portion of one spline seal is inserted into a corresponding second slot on said second rotor blade; and one or more seal pins configured to prevent cooling air from leaking between aft skirts.

10. A gas turbine engine according to claim 9 wherein said one or more seal pins is tapered with a radially outer radius greater than a radially inner radius when assembled in said gas turbine engine.

11. A gas turbine engine according to claim 10, wherein said one or more tapered seal pins has a radially outer diameter of approximately 0.08 inches and a radially inner diameter of approximately 0.04 inches.

12. A gas turbine engine according to claim 9 wherein said rotor assembly comprises an equal number of said rotor blades as said one or more seal pins.

13. A gas turbine engine according to claim 9, wherein each slot is oriented to facilitate movement of said spline seal from a first position to a second position within each slot during operation of said gas turbine engine.

14. A method of assembling a rotor assembly for use with gas turbine engine, comprising an axis of rotation, said method comprising:

providing a plurality of rotor blades, wherein each rotor blade comprises a platform extending between opposing side faces, a shank extending radially inward from the platform, a dovetail extending radially inward from the shank, and a slot at least partially defined in each of the opposing side faces, the shank comprising a cavity;

inserting a spline seal into each slot of a first rotor blade of the plurality of rotor blades such that at least a portion of each spline seal extends beyond one of the opposing side faces;

coupling a second rotor blade of the plurality of rotor blades adjacent the first rotor blade such that at least a portion of one spline seal is inserted into a corresponding second slot on said second rotor blade; and inserting one or more seal pins into the shank cavity to prevent cooling air from leaking.

15. A method according to claim 14, wherein said platform comprises a radially outward portion of each slot.

16. A method according to claim 14, wherein said shank comprises opposing seal support members, and wherein each of the opposing seal support members comprises a radially inward portion of each slot.

17. A method according to claim 14 further comprising orienting each slot to facilitate movement of said spline seal from a first position to a second position within each slot during operation of the gas turbine engine.

18. A method according to claim 14 further comprising: defining a gap between said first rotor blade and said second rotor blade; and sealing at least a portion of the gap using the spline seal.

* * * * *